US011286706B2

(12) United States Patent
Wirths et al.

(10) Patent No.: US 11,286,706 B2
(45) Date of Patent: Mar. 29, 2022

(54) MOTOR VEHICLE LOCK ASSEMBLY

(71) Applicant: Brose Fahrzeugteile SE & Co. Kommanditgesellschaft, Bamberg, Bamberg (DE)

(72) Inventors: Rainer Wirths, Wuppertal (DE); Michael Pleines, Essen (DE)

(73) Assignee: Brose Fahrzeugteile GmbH SE & Co. Kommanditgesellschaft, Bamberg, Bamberg (DE)

( * ) Notice: Subject to any disclaimer, the term of this patent is extended or adjusted under 35 U.S.C. 154(b) by 341 days.

(21) Appl. No.: 16/337,757

(22) PCT Filed: Sep. 27, 2017

(86) PCT No.: PCT/EP2017/074454
§ 371 (c)(1),
(2) Date: Mar. 28, 2019

(87) PCT Pub. No.: WO2018/060226
PCT Pub. Date: Apr. 5, 2018

(65) Prior Publication Data

US 2020/0002996 A1 Jan. 2, 2020

(30) Foreign Application Priority Data

Sep. 30, 2016 (DE) ..... 10 2016 118 685.6

(51) Int. Cl.
*E05F 15/00* (2015.01)
*E05F 15/73* (2015.01)
(Continued)

(52) U.S. Cl.
CPC ..... *E05F 15/73* (2015.01); *E05B 81/06* (2013.01); *E05B 81/14* (2013.01); *E05B 81/20* (2013.01);
(Continued)

(58) Field of Classification Search
CPC ..... E05B 81/14; E05B 81/77; E05B 81/06; E05B 81/20; E05B 83/36; E05F 15/73;
(Continued)

(56) References Cited

U.S. PATENT DOCUMENTS 9,045,921 B2 6/2015 Eggeling et al.
9,205,727 B2 12/2015 Herthan
(Continued)

FOREIGN PATENT DOCUMENTS

DE 10361115 7/2005
DE 102005017250 6/2006
(Continued)

OTHER PUBLICATIONS

Chinese Search Report for Chinese Patent Application No. 201780060647.5 dated Apr. 27, 2020 (3 pages) English Translation Only.
(Continued)

*Primary Examiner* — Chi Q Nguyen
(74) *Attorney, Agent, or Firm* — Pauly, DeVries Smith & Deffner LLC

(57) ABSTRACT

A lock arrangement for a vehicle door, which is connected in an adjustable manner to a motor vehicle body, wherein a motor vehicle lock is provided that in the mounted state is arranged on the motor vehicle door or on the motor vehicle body, wherein the motor vehicle lock arrangement, in particular the motor vehicle lock, comprises a push-open arrangement with which the motor vehicle door may be adjusted in a motorized push-open procedure out of a door closed position, in particular a door main-closed position or a door pre-closed position into a door push-open position that is lying further in its opening direction and as a consequence a gap, may be produced between the motor vehicle body and a door engagement edge of the motor
(Continued)

vehicle door, wherein a control arrangement and connected thereto in terms of control technology a sensor arrangement are provided.

19 Claims, 3 Drawing Sheets

(51) Int. Cl.
*E05B 81/06* (2014.01)
*E05B 81/14* (2014.01)
*E05B 81/20* (2014.01)
*E05B 81/76* (2014.01)
*E05B 83/36* (2014.01)

(52) U.S. Cl.
CPC ..... *E05B 81/77* (2013.01); *E05B 83/36* (2013.01); *E05F 2015/763* (2015.01); *E05F 2015/765* (2015.01); *E05Y 2201/43* (2013.01); *E05Y 2400/41* (2013.01); *E05Y 2400/44* (2013.01); *E05Y 2400/86* (2013.01); *E05Y 2900/531* (2013.01)

(58) Field of Classification Search
CPC ..... E05F 2015/765; E05F 2015/763; E05Y 2400/44; E05Y 2201/43; E05Y 2900/531; E05Y 2400/41; E05Y 2408/86
USPC ..... 49/31
See application file for complete search history.

(56) References Cited

U.S. PATENT DOCUMENTS

| | | | | |
|---|---|---|---|---|
| 10,287,805 | B2 | 5/2019 | Faust et al. | |
| 2010/0026014 | A1* | 2/2010 | Machida | E05B 81/20 292/216 |
| 2010/0052337 | A1* | 3/2010 | Arabia, Jr | E05B 81/14 292/216 |
| 2010/0253095 | A1* | 10/2010 | Bendel | E05B 81/14 292/200 |
| 2014/0001771 | A1* | 1/2014 | Shibayama | E05B 81/20 292/100 |
| 2014/0137474 | A1* | 5/2014 | Suzuki | E05B 81/14 49/31 |
| 2015/0061301 | A1* | 3/2015 | Torka | E05B 85/20 292/194 |
| 2016/0032630 | A1* | 2/2016 | Machida | E05B 81/20 292/201 |
| 2016/0245010 | A1* | 8/2016 | Makino | F16H 37/122 |
| 2016/0251879 | A1* | 9/2016 | Behnke | E05B 81/20 292/200 |
| 2016/0251888 | A1* | 9/2016 | Makino | E05B 83/40 49/280 |
| 2017/0130490 | A1 | 5/2017 | Wirths | |
| 2017/0321456 | A1* | 11/2017 | Jeong | E05B 79/20 |
| 2017/0342749 | A1* | 11/2017 | Nelson | E05B 79/10 |
| 2018/0179790 | A1* | 6/2018 | Jeong | E05B 85/00 |

FOREIGN PATENT DOCUMENTS

| | | |
|---|---|---|
| DE | 102010060364 | 5/2012 |
| DE | 102011018847 | 10/2012 |
| DE | 102012108004 | 3/2014 |
| DE | 102013018594 | 5/2015 |
| DE | 102013018838 | 5/2015 |
| DE | 102013114883 | 6/2015 |
| DE | 102014205371 | 9/2015 |
| FR | 2936267 | 3/2010 |
| JP | 2013028903 | 2/2013 |
| JP | 2015200617 | 11/2015 |
| KR | 100887688 | 3/2009 |
| WO | 2009024602 | 2/2009 |
| WO | 2011026763 | 3/2011 |
| WO | 2017207478 | 12/2017 |
| WO | 2018060226 | 4/2018 |

OTHER PUBLICATIONS

"German Search Report," for German Patent Application No. 102016118685.6 dated Jun. 20, 2017 (8 pages).
"International Search Report and Written Opinion," for PCT Application No. PCT/EP2017/074454 dated Nov. 28, 2017 (19 pages) with English translation.

* cited by examiner

MOTOR VEHICLE LOCK ASSEMBLY

CROSS-REFERENCE TO RELATED APPLICATIONS

This application is a national stage application under 35 U.S.C. 371 of International Patent Application Serial No. PCT/EP2017/074454, entitled "Motor Vehicle Lock Assembly," filed Sep. 27, 2017, which claims priority from German Patent Application No. DE 10 2016 118 685.6, filed Sep. 30, 2016, the disclosure of which is incorporated herein by reference.

FIELD OF THE TECHNOLOGY

The disclosure relates to a motor vehicle lock arrangement and also to a method for controlling such a motor vehicle lock arrangement.

BACKGROUND

In the case of the motor vehicle lock arrangement under discussion, the operating comfort especially as a motor vehicle door is being opened is increased. This increase in the operating comfort is as a result of the fact that the motor vehicle lock arrangement provides a motorized push-open function. This means that it is possible to adjust the motor vehicle door by means of a push-open arrangement from the fully closed position into a door push-open position and in fact to adjust said motor vehicle door in such a manner that an engagement gap is formed between the motor vehicle body and a door engagement edge of the motor vehicle door. As a consequence, the operator is able to grip behind the door engagement edge with the hand and manually open the motor vehicle door in a comfortable manner. In addition to increasing the comfort factor, the motor vehicle lock arrangement under discussion provides a new design freedom when designing the motor vehicle door since external door handles may be completely omitted. DE 10 2014 205 371 A1 discloses such a motor vehicle lock arrangement.

One challenge in the case of the known motor vehicle lock arrangement resides in triggering the push-open procedure in the correct manner. A satisfactory solution to this problem has hitherto not been provided. Depending upon the configuration, the overall resulting operating comfort is however also comparatively low.

SUMMARY

The disclosure is based on the problem to design and further develop the known motor vehicle lock arrangement in such a manner that the operating comfort is increased.

An essential aspect is the fundamental consideration that the operating comfort as the motor vehicle door is being opened is to be considerably increased if the push-open procedure is triggered by means of an operator performing a triggering gesture. As a consequence, it is possible to open the motor vehicle door resolutely in an intuitive manner.

In detail, it is proposed that it is possible by means of a control arrangement that is connected in terms of control technology to the above mentioned sensor arrangement to detect a predetermined operator's triggering gesture. In the event that this predetermined operator's triggering gesture is detected, the control arrangement subsequently triggers the push-open procedure. The operator's triggering gesture is in this case advantageously configured in such a manner that it is possible to proceed smoothly into a procedure of gripping behind the door engagement edge.

In the case of some embodiments, the operator's triggering gesture includes the operator performing a predetermined triggering hand movement. The operator's triggering gesture may however also include further aspects with respect to the position, approaching movement, approaching speed, body position or the like of the operator. It is to be noted in this connection that also multiple predetermined operator's trigging gestures may be defined that may trigger the push-open procedure or other procedures.

In the case of some embodiments, the movement of the operator's hand and the push-open procedure are synchronized and in fact in such a manner that at the point in time at which the operator's hand arrives at the door engagement edge the push-open procedure is already triggered, is already in an advanced stage or has already been completed. Consequently, it is possible to avoid waiting times that the operator would have to accept possibly until the push-open procedure is completed.

Various embodiments relate to advantageous constructional variants for the configuration of the sensor arrangement. In this case, it is possible by virtue of configuring the sensor arrangement as a capacitive sensor arrangement in accordance with claim 6 for said sensor arrangement to be integrated into the motor vehicle door in such a manner that the installation space is optimized.

Various embodiments relate to equipping the motor vehicle lock arrangement with a closing assist arrangement that renders possible a motorized closing assist procedure of the motor vehicle door from a door pre-closed position into the fully closed position. In this case, it can be provided that the sensor arrangement is controlled differently by the control arrangement depending upon the position of the motor vehicle door. As a consequence, the sensor arrangement may also provide other functions in addition to detecting the operator's triggering gesture. In this case, such a function may be by way of example detecting that the operator has issued an emergency off command during the closing assist procedure.

According to a further embodiments, a method for controlling a proposed motor vehicle lock arrangement is provided.

An essential aspect according to the proposed method is that it is possible by means of the control arrangement to detect via the sensor arrangement a predetermined operator's triggering gesture and that the push-open procedure is triggered in the event that the predetermined operator's triggering gesture is detected. In this respect, reference is made to all statements relating to the mode of operation of the proposed motor vehicle lock arrangement.

In some embodiments, the above mentioned synchronization between the push-open procedure and the movement of the operator's hand is proposed. Also in this respect, reference is made to the statements relating to the mode of operation of the proposed motor vehicle lock arrangement.

Various embodiments provide a motor vehicle lock arrangement for a motor vehicle door, in particular a side door, which is connected in such a manner as to be able to be adjusted to a motor vehicle body, wherein a motor vehicle lock is provided that in the mounted state is arranged on the motor vehicle door or on the motor vehicle body, wherein the motor vehicle lock arrangement, in particular the motor vehicle lock, comprises a push-open arrangement with which the motor vehicle door may be adjusted in a motorized push-open procedure out of a door closed position, in particular a door main-closed position or a door pre-closed position, into a door push-open position that is lying further in its opening direction and as a consequence a gap, in particular an engagement gap, may be produced between the motor vehicle body and a door engagement edge of the motor vehicle door, wherein a control arrangement and connected thereto in terms of control technology a sensor arrangement are provided, characterized in that it is possible by means of the control arrangement to detect via the sensor arrangement a predetermined operator's triggering gesture and that the push-open procedure is triggered by means of the control arrangement in the event that the predetermined operator's triggering gesture is detected.

In some embodiments, the predetermined operator's triggering gesture includes a predetermined triggering hand movement and that the triggering hand movement includes a predetermined movement pattern, in particular a predetermined movement path and/or a predetermined movement speed and/or a predetermined movement speed progression and/or a predetermined movement acceleration and/or a predetermined movement acceleration progression.

In some embodiments, the triggering hand movement moves toward the door engagement edge of the motor vehicle door or ends in the region of the door engagement edge of the motor vehicle door or brushes over the door engagement edge of the motor vehicle door.

In some embodiments, at least one part of the triggering hand movement moves essentially in a transverse manner toward the door engagement edge.

In some embodiments, the control arrangement controls the push-open procedure in response to the detection of the operator's triggering gesture in such a manner that as the movement of the operator's hand progresses, in particular at an unchanged movement speed, in the direction of the door engagement edge at the point in time at which the operator's hand arrives at the door engagement edge, the push-open procedure is already triggered, is already in an advanced stage or has already been completed.

In some embodiments, the sensor arrangement is configured as a capacitive sensor arrangement, in particular as a capacitive proximity sensor arrangement, such that the sensor arrangement can comprise at least one measuring electrode that is connected in terms of control technology to the control arrangement, wherein between the measuring electrode and a further electrode or the motor vehicle ground there is a measured capacitance, the magnitude of which is dependent upon the position of the operator's hand.

In some embodiments, the at least one measuring electrode is configured in an elongated manner, such that the at least one measuring electrode is configured essentially in a transverse manner with respect to at least one part of the triggering hand movement.

In some embodiments, the sensor arrangement is arranged at least in part in a hollow space of the motor vehicle door, in particular behind the door outer panel of the motor vehicle door, such as behind an opening in the door outer panel of the motor vehicle door or that the sensor arrangement is arranged in a hollow space of the motor vehicle body, in particular behind a body panel of the motor vehicle body, or that the sensor arrangement is arranged at least in part in or on an add-on part, such as between the add-on part and the motor vehicle door.

In some embodiments, the motor vehicle lock arrangement, in particular the motor vehicle lock, comprises a closing assist arrangement with which it is possible to adjust the motor vehicle door in a motorized closing assist procedure out of a door pre-closed position into a door main-closed position which lies further in its closing direction.

In some embodiments, the closing assist arrangement provides at least a part of the push-open arrangement, such as that the closing assist arrangement and the push-open arrangement share one drive motor for generating drive movements.

In some embodiments, the control arrangement controls the sensor arrangement differently on the one hand in the case of a closed motor vehicle door and on the other hand in the case of an at least slightly open motor vehicle door, in particular during the closing assist procedure, in particular a different sensitivity of the sensor arrangement is set.

In some embodiments, the motor vehicle lock comprises a lock latch that with a locking part, in this case a locking bar, and a retaining catch that is allocated to the lock latch and that the push-open arrangement is connected or may be connected to the lock latch, such as that within the scope of the push-open procedure the adjustment of the motor vehicle door into the door push-open position is in response to the adjustment of the lock latch in its opening direction by means of the push-open arrangement and/or that within the scope of the closing assist procedure the adjustment of the motor vehicle door into the door main-closed position is in response to the adjustment of the lock latch in its closing direction by means of the push-open arrangement.

In some embodiments, an opening assist arrangement is provided with which the retaining catch may be released in a motorized manner and that within the scope of the push-open procedure the control arrangement initially triggers the motorized release of the retaining catch.

Various embodiments provide a method for controlling a motor vehicle lock arrangement as described herein, it can be possible by means of the control arrangement to detect via the sensor arrangement a predetermined operator's triggering gesture and that the push-open procedure is triggered by means of the sensor arrangement in the event that the predetermined operator's triggering gesture is detected.

In some embodiments, by means of the control arrangement the push-open procedure is controlled in response to the detection of the operator's triggering gesture in such a manner that as the movement of the operator's hand progresses, in particular at an unchanged movement speed, in the direction of the door engagement edge at the point in time at which the operator's hand arrives at the door engagement edge, the push-open procedure is already triggered, is already in an advanced stage or has already been completed.

BRIEF DESCRIPTION OF THE DRAWINGS

The disclosure is explained in detail below with the aid of a drawing illustrating only one exemplary embodiment. In the drawing.

Figure 1:
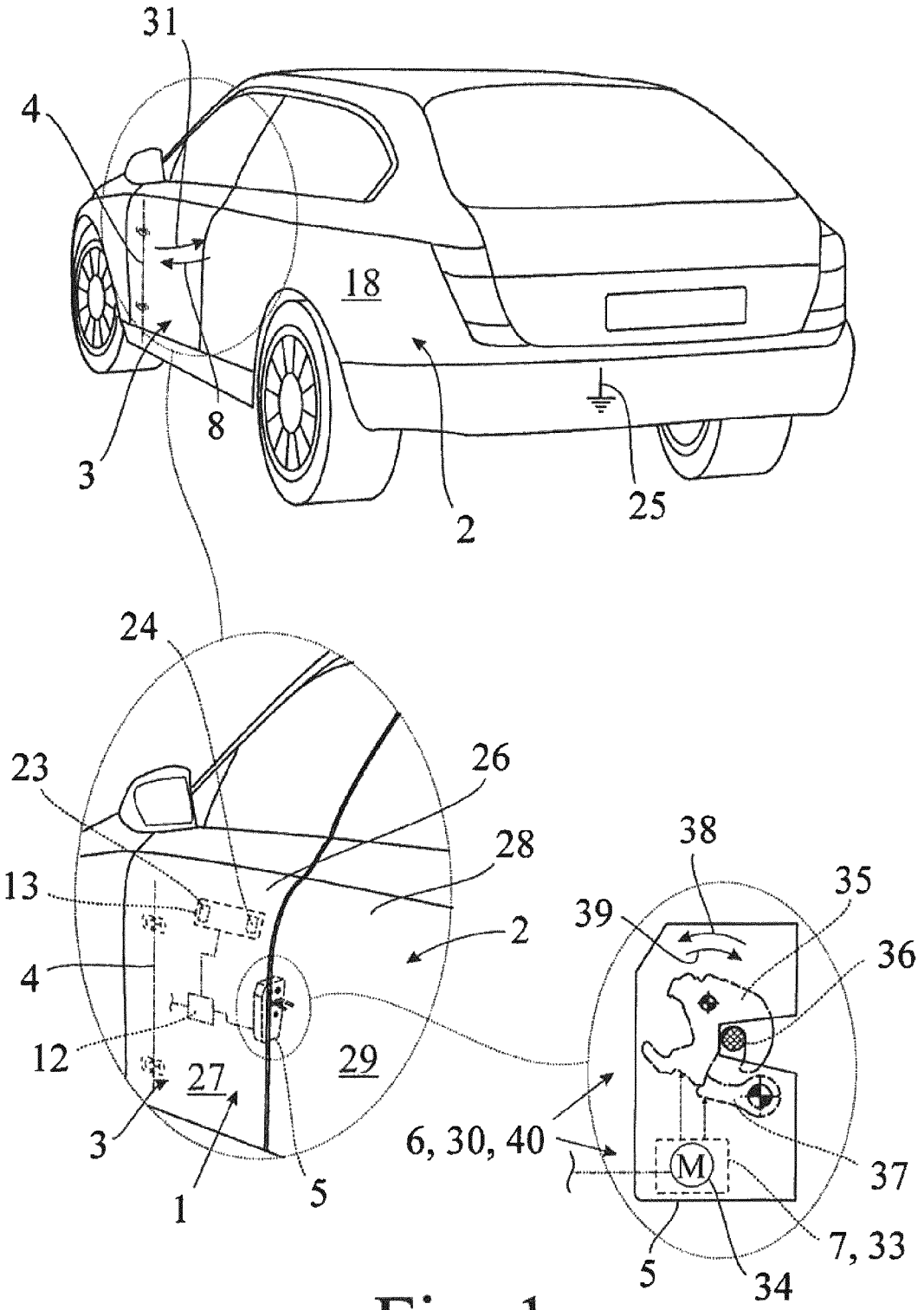
FIG. 1 illustrates a motor vehicle having a proposed motor vehicle lock arrangement in a first embodiment.

a) in the door main-closed position, b) in the push-open door closed position, c) in the door pre-closed position.

DETAILED DESCRIPTION

The proposed motor vehicle lock arrangement 1 is allocated to a motor vehicle door 3 that is connected in an adjustable manner to a motor vehicle body 2. In the illustrated embodiment, the motor vehicle door 3 is a side door. However, fundamentally, the motor vehicle door 3 may also be a rear door. In both cases, it can be that the motor vehicle door 3 is able to pivot about a geometric door axis 4 that is essentially oriented in a vertical manner, wherein during the pivot movement it is not necessary for the door axis 4 to be fixed. Moreover, it is to be noted that the motor vehicle door 3 may also be configured as a sliding door. The motor vehicle lock arrangement 1 comprises a motor vehicle lock 5 that in the mounted state can be arranged on the motor vehicle door 3. Alternatively, it is also possible to provide that the motor vehicle lock 5 is arranged on the motor vehicle body 2.

The proposed motor vehicle lock arrangement 1 comprises a push-open arrangement 6 having a push-open drive 7 that comprises a drive train for exerting a driving force on the motor vehicle door 3 in its opening direction 8. As a consequence, the motor vehicle door 3 may be adjusted by means of the push-open arrangement 6 in a motorized push-open procedure 9 out of a door closed position (FIG. 3*a*) into a door push-open position that is lying further in its opening direction 8 (FIG. 3*b*). As a consequence, it is possible in turn to produce a gap 10, in this case an engagement gap 10, between the motor vehicle body 2 and a door engagement edge 11 of the motor vehicle door 3. In this case, the push-open arrangement 6 is allocated to the motor vehicle lock 5 with the result that it is possible to pre-mount the push-open arrangement 6 together with the motor vehicle lock 5 which is advantageous in terms of manufacturing technology. However, it is fundamentally also possible to configure the push-open arrangement 6 separately from the motor vehicle lock 5.

The push-open procedure 9 is apparent for both embodiments from the transition from FIG. 3*a* to FIG. 3*b*. In this case, the door closed position from which the push-open procedure 9 starts can be the door main-closed position, in other words the fully closed position of the motor vehicle door 3. However, it is fundamentally also possible that this door closed position is the door pre-closed position shown in FIG. 3*c* that is still to be explained below.

The gap 10 that is generated within the scope of the push-open procedure 9 is in this case an engagement gap that is dimensioned such that the engagement gap 10 and in particular the door engagement edge 11 may be gripped behind by the operator's hand H. In the door push-open position (FIG. 3*b*), an engagement gap 10 is produced that has a gap width greater than 18 mm and, in further embodiments, greater than 22 mm. In some embodiments, the gap width of the engagement gap 10 is between approx. 26 mm and approx. 31 mm. In some embodiments, the gap width of the engagement gap 10 is approx. 30 mm. These values have proven to be advantageous particularly for the operator's hand H to grip behind the engagement gap 10, in particular the door engagement edge 11.

In the door pre-closed position, only a gap 10 that has a gap width of less than 10 mm, such as approx. 6 mm, remains between the motor vehicle body 2 and the motor vehicle door 3, in particular the door engagement edge 11. All gap widths are in this case always measured in the opening direction 8 of the motor vehicle door 3.

The triggering of the push-open procedure 9 is of particular importance in this case. For this purpose, in the first instance a control arrangement 12 and a sensor arrangement 13 that is connected to the control arrangement 12 in terms of control technology are provided. The control arrangement 12 is used in this case to control the motor vehicle lock arrangement 1 overall. Depending upon the configuration of the sensor arrangement 13, the procedure of controlling the sensor arrangement 13 includes the procedure of supplying the sensor arrangement 13 with a supply voltage and/or a measuring voltage and also receiving the sensor signals that are generated by the sensor arrangement 13. In some embodiments and in this case capacitive sensor arrangement 13, the control arrangement 12 acts upon the sensor arrangement 13 with a measuring voltage and from the resulting electrical behaviour of the sensor arrangement 13 ascertains the existence of the operator's hand H and/or the distance between the operator's hand H and the sensor arrangement 13.

Figure 3:
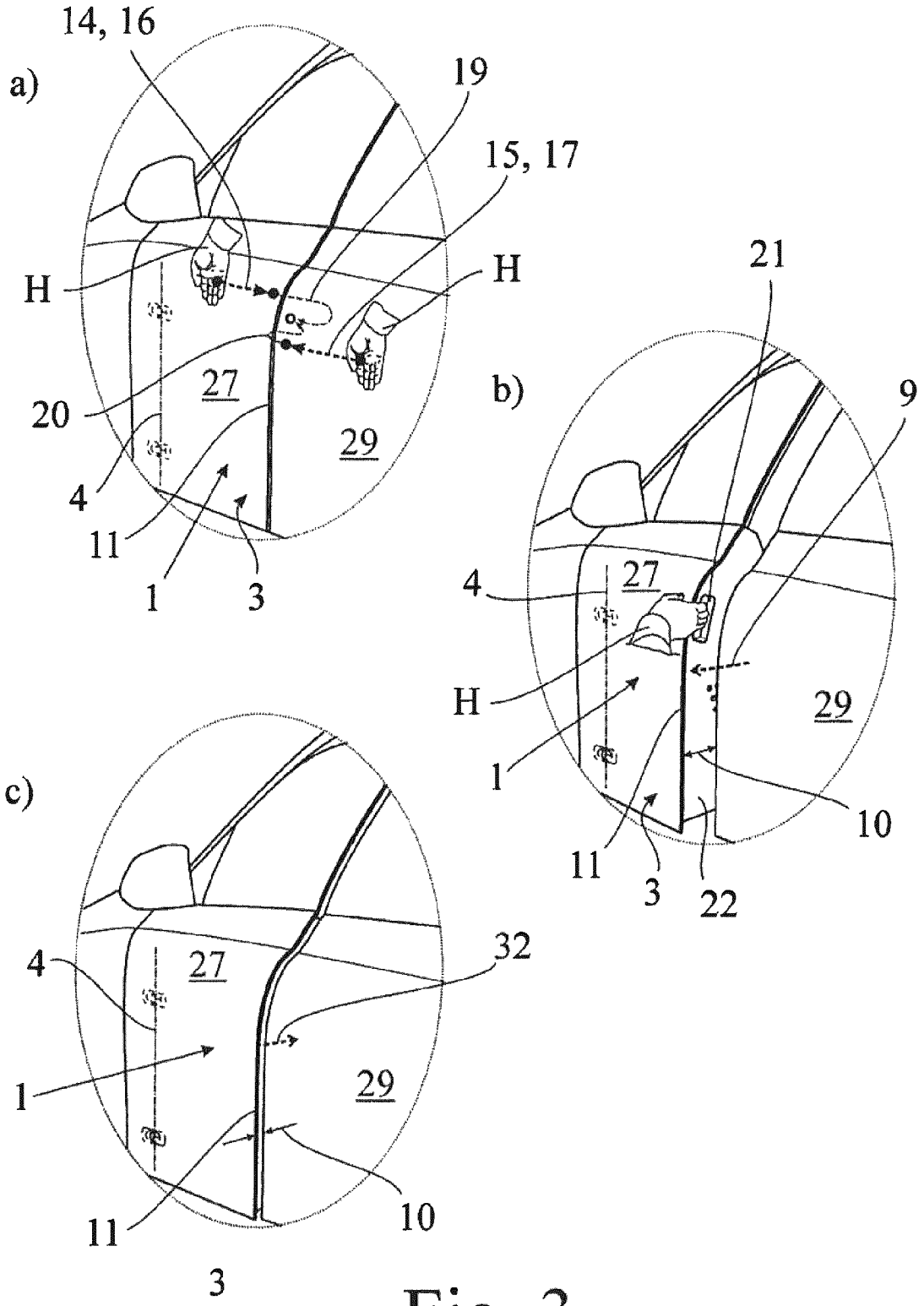

An essential aspect is now that it is possible by means of the control arrangement 12 to detect via the sensor arrangement 13 a predetermined operator's triggering gesture 14, 15, wherein the control arrangement 12 upon detecting a predetermined operator's triggering gesture 14, 15 triggers the push-open procedure 9. In this case, it is also possible to define multiple operator's triggering gestures 14, 15 that in each case trigger the push-open procedure 9. FIG. 3 illustrates two such operator's triggering gestures 14, 15.

The operator's triggering gesture 14, 15 may be defined in a quite different manner. By way of example, it is conceivable that the position, approaching movement, approaching speed, body position or the like of the operator are defined in the operator's triggering gesture 14, 15. In this case, the predetermined operator's triggering gesture 14, 15 includes in any case a predetermined triggering hand movement 16, 17. The triggering hand movement 16, 17 includes in accordance with FIG. 3*a* such as a predetermined movement pattern, in particular a predetermined movement path. In this case, the movement pattern may be defined by way of example such that the movement pattern includes a swiping movement or a to and fro movement. The movement path may be defined in relation to the motor vehicle body 2 by a sequence of absolute positions. However, it can be that the movement path is defined as such and in fact irrespective of its absolute position. It can be that a movement pattern or rather a movement path is deemed to be detected in terms of the operator's triggering gesture 14, 15 if the movement pattern or rather the movement path lies in a predetermined region of the motor vehicle body 2 or of the motor vehicle door 3.

As an alternative or in addition thereto, the triggering hand movement 16, 17 may include a predetermined movement speed and/or a predetermined movement speed progression. Furthermore, it is conceivable that the triggering hand movement 16, 17 includes a predetermined movement acceleration and/or a predetermined movement acceleration progression.

As described above, it can be provided that the triggering hand movement 16, 17 includes a swiping movement of the operator's hand H along an outer skin 18 of the motor vehicle. In this case, the outer skin may be the outer skin 18 of the motor vehicle door 3 or of a further motor vehicle door or motor vehicle body 2.

Fundamentally, the triggering hand movement 16, 17 may be in the direction away from the door engagement edge 11. In view of the fact that the engagement gap 10, in particular the door engagement edge 11, may be gripped from behind by the operator's hand H, it can be provided that the triggering hand movement 16, 17 moves toward the door engagement edge 11, as is indicated in FIG. 3*a* with two possible triggering hand movements that move in opposite directions.

As an alternative, it is possible to provide that the triggering hand movement 16, 17 ends in the region of the door engagement edge 11 of the motor vehicle door 3 or even brushes over the door engagement edge 11 of the motor vehicle door 3.

Quite generally, it can be provided that at least one part of the triggering hand movement 16, 17 moves essentially in a transverse manner with respect to the door engagement edge 11. In this case, the triggering hand movement 16, 17 may move, as described above, along the outer skin 18 of the motor vehicle. However, it is also conceivable that the triggering hand movement 16, 17 moves in a transverse manner with respect to the outer skin 18 or at an angle to the outer skin 18.

It is in this case of quite particular importance that the push-open procedure 9 is synchronized with the movement of the operator's hand H. It can be that the control arrangement 12 controls the push-open procedure 9 in response to the detection of the operator's triggering gesture 14, 15 in such a manner that as the movement 19, 20 of the operator's hand H progresses in the direction of the door engagement edge 11 at the point in time at which the operator's hand H arrives at the door engagement edge 11, the push-open procedure 9 is already triggered, is already in an advanced stage or has already been completed. This means that the motor vehicle door 3 is already partially or even fully pushed open if the operator's hand H arrives at the door engagement edge 11. It is therefore not necessary for the operator to wait for the push-open procedure 9 to be completed.

FIG. 3*a* illustrates that the continued movement 19, 20 becomes the movement as mentioned above of gripping behind the engagement gap 10. The movement of gripping behind said engagement gap is illustrated by way of example in FIG. 3*b*, in which the operator's hand H moves into a pocket 21 that is provided especially for this purpose in the end face 22 of the motor vehicle door 3.

It is possible to achieve the above mentioned synchronization between the push-open procedure 9 and the triggering hand movement 16, 17 in a particularly simple manner by virtue of the fact that the triggering hand movement 16, 17 is upstream of the door engagement edge 11. It is consequently achieved that the operator's triggering gesture 14, 15 is detected by means of the control arrangement 12 before the operator's hand H arrives at the door engagement edge 11. Provided that the push-open procedure 9 is triggered immediately after the operator's triggering gesture 14, 15 is detected, it is possible to use the remaining, continued movement 19, 20 up to the door engagement edge 11 in order to start or even complete the push-open procedure 9.

However, it is also conceivable that the movement speed of the operator's hand H is already ascertained with the detection of the operator's triggering gesture 14, 15 with the result that it is possible to calculate the point in time at which the operator's hand H is expected to arrive at the door engagement edge 11. Based on this calculation, it is possible for the push-open procedure 9 to be performed by virtue of the push-open drive 7 being controlled accordingly in such a manner that the push-open procedure is completed in good time in the above mentioned sense. In this case, it is possible to assume in a simple manner that the movement speed of the continued movement 19, 20 remains unchanged with respect to the movement speed during the triggering hand movement 16, 17.

Quite different advantageous variants are conceivable for the configuration of the sensor arrangement 13. By way of example, the sensor arrangement 13 may be based on different sensoring principles. It is conceivable to configure the sensor arrangement 13 as an inductive sensor arrangement or as an optical sensor arrangement, as an ultrasound-based sensor arrangement or the like. In this case, the sensor arrangement 13 is however configured as a capacitive sensor arrangement, in particular as a capacitive proximity sensor arrangement. By virtue of its simple construction, such a capacitive sensor arrangement 13 may be readily installed in a manner which optimizes the installation space and at the same time offers a high degree of robustness with respect to interference factors, such as changing environmental conditions, in particular with respect to moisture, contamination or the like. Such a capacitive sensor arrangement 13 comprises at least one measuring electrode 23, 24 that is connected in terms of control technology to the control arrangement 12, wherein between the measuring electrode 23, 24 and the motor vehicle ground 25 there is a measured capacitance, the magnitude of which is dependent upon the position of the operator's hand H. It is fundamentally also possible that the measured capacitance is provided between the measuring electrode 23, 24 and a further electrode. In this case two measuring electrodes 23, 24 are provided that one after the other detect the operator's hand H with regards to the illustrated triggering hand movements 16, 17.

One option for detecting the existence or rather the position of the operator's hand H prior to the respective measuring electrode 23, 24, resides in the fact that the control arrangement 12 acts upon the measuring electrode 23, 24 with respect to ground 25 with an alternating voltage and on the basis of the resulting current progression the magnitude of the measured capacitance is concluded and on the basis of said magnitude of the measured capacitance the existence or rather position of the operator's hand H is concluded. In this case, the operator's triggering gesture 14, 15 is deemed to be detected if the two measuring electrodes 23, 24 have detected the operator's hand H in a predetermined sequence and within a predetermined time interval.

Fundamentally different design variants are conceivable for the configuration of the measuring electrodes 23, 24. In this case, the measuring electrodes 23, 24 are each configured in an elongated manner. It can be that the measuring electrodes 23, 24 are oriented essentially in a transverse manner with respect to at least one part of the triggering hand movement 16, 17.

In the case of the configuration illustrated in FIG. 1, the sensor arrangement 13 is arranged, at least in part in this case completely, in a hollow space 26 in the motor vehicle door 3, in particular behind the door outer panel 27 of the motor vehicle door 3. In this case, it is fundamentally advantageous that the door outer panel 27 comprises an opening, not illustrated, through which it is possible for the operator's hand H to make contact with the sensor arrangement 13. The arrangement illustrated in FIG. 1 renders it possible for the triggering hand movement 16 illustrated in FIG. 3*a* to be detected.

Figure 2:
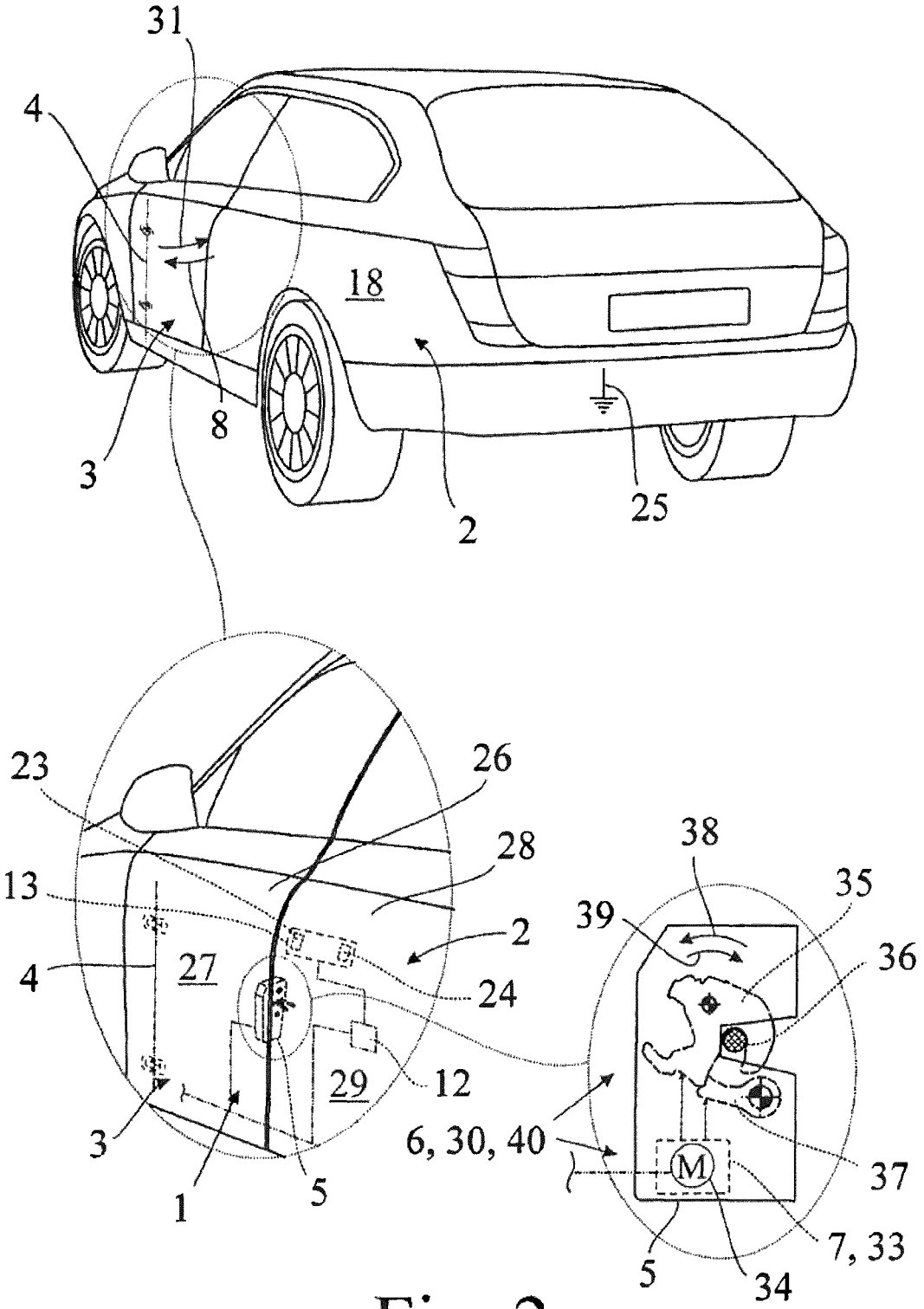
FIG. 2 illustrates a motor vehicle having a proposed motor vehicle lock arrangement in a second embodiment and FIG. 3 illustrates the motor vehicle door that is allocated respectively to the proposed motor vehicle lock arrangement in accordance with FIG. 1, 2.

It is possible as an alternative to provide that the sensor arrangement 13 is arranged in a hollow space 28 of the motor vehicle body 2, in this case behind a body panel 29 of the motor vehicle body 2. This is apparent in the illustration in accordance with FIG. 2. The position of the sensor arrangement 13 illustrated in FIG. 2 renders it possible for the triggering hand movement 17 illustrated in FIG. 3*a* to be detected.

As an alternative, the sensor arrangement 13 may be arranged at least in part in or on an add-on part, such as between the add-on part and the motor vehicle door 3. Said add-on part may be by way of example a window bar, a decorative strip, a badge or the like.

In addition to the above mentioned push-open arrangement 6, the proposed motor vehicle lock arrangement 1, in particular the motor vehicle lock 5, comprises in addition a closing assist arrangement 30 with which it is possible to adjust the motor vehicle door 3 in a motorized closing assist procedure 32 out of a door pre-closed position (FIG. 3*c*) into a door main-closed position which lies further in its closing direction 31 and in which door main-closed position the motor vehicle door 3 is fully closed. This is in this respect a comfort function as it is only necessary for the operator when closing the motor vehicle door 3 to move the motor vehicle door 3 into the door pre-closed position that is illustrated in FIG. 3*c* and in which high door sealing pressures are regularly not yet active. The procedure of pulling the motor vehicle door 3 shut against the door sealing pressures into the fully closed position, in other words into the above mentioned door main-closed position, is subsequently assumed by a closing assist drive 33 of the closing assist arrangement 30. A particularly compact and simultaneously cost-effective configuration is provided in this case by virtue of the fact that the closing assist arrangement 30 provides at least a part of the push-open arrangement 6. In detail, it can be provided that the closing assist arrangement 30 and the push-open arrangement 6 share one drive motor 34 for generating drive movements.

A sensor arrangement 13 is used in a particularly effective manner in this case by virtue of the fact that in some configurations the control arrangement 12 controls the sensor arrangement 13 differently on the one hand in the case of a closed motor vehicle door 3 and on the other hand in the case of an at least slightly open motor vehicle door 3, in particular during the closing assist procedure 32. It is by way of example conceivable in this case that the control arrangement 12 deactivates the sensor arrangement 13 during the closing assist procedure 32. In any case, the term "deactivated" means in this case that the control arrangement 12 is not receiving any sensor measured values from the sensor arrangement 13. It can be that this means in addition that the control arrangement 12 switches the measuring electrodes 23, 24 to the de-energized mode.

It is also conceivable that the control arrangement 12 sets a different sensitivity of the sensor arrangement 13 depending upon the position of the motor vehicle door 3. This means by way of example that the sensor arrangement 13 is adjusted depending upon the sensitivity to different distance ranges.

Different advantageous variants are conceivable for the configuration of the motor vehicle lock 5. It is apparent from FIGS. 1, 2 that the motor vehicle lock 5 comprises a lock latch 35 that with a locking part 36, in this case a locking bar, and a retaining catch 37 that is allocated to the lock latch 35. Such an arrangement of a locking system having a lock latch 35 and a retaining catch 37 is fundamentally known. It is possible to move the lock latch 35 into a main-closed position and for the retaining catch 37 to hold said lock latch there with the result that the motor vehicle door 3 is in the door main-closed position. Moreover, it is possible to move the lock latch 35 into a pre-closed position and for the retaining catch 37 to hold said lock latch there with the result that the motor vehicle door 3 is in the door pre-closed position.

An interesting aspect in this case is the fact that the push-open arrangement 6 is connected or may be connected to the lock latch 35. In this case, it is provided in the first instance that the adjustment of the motor vehicle door 3 into the door push-open position is in response to the adjustment of the lock latch 35 in its opening direction 38 by means of the push-open arrangement 6. As an alternative and in addition thereto, it is provided that within the scope of the closing assist procedure 32 the adjustment of the motor vehicle door 3 into the door main-closed position is in response to the adjustment of the lock latch 35 in its closing direction 39 by means of the push-open arrangement 6. In this respect, the lock latch 35 is used in this case for multiple functions, namely for maintaining engagement with the locking part 36, for transmitting the forces required for the push-open procedure 9 and for transmitting the forces required for the closing assist procedure 32.

In turn, as an alternative or in addition thereto, it is possible to provide that an opening assist arrangement 40 is provided with which the retaining catch 37 may be released in a motorized manner, wherein within the scope of the push-open procedure 9 the control arrangement 12 initially triggers the motorized release of the retaining catch 37 and only subsequently triggers the control of the push-open drive 7 to push open the motor vehicle door 3. It can be in this case that the opening assist arrangement 40, the closing assist arrangement 30 and the push-open arrangement 6 share one drive motor 34 for generating drive movements.

According to further embodiments, a method for controlling a proposed motor vehicle lock arrangement 1 is provided.

An aspect of various embodiments is that it is possible by means of the control arrangement 12 to detect via the sensor arrangement 13 a predetermined operator's triggering gesture, wherein the push-open procedure is triggered by means of the control arrangement 12 in the event that the predetermined operator's triggering gesture is detected. In this respect, reference may be made to all statements relating to the mode of operation of the proposed motor vehicle lock arrangement 1. This applies in particular for the further above explained synchronization of the push-open procedure 9 with respect to the operator's triggering gesture 14, 15 in particular the triggering hand movement 16, 17.

The invention claimed is:

1. A motor vehicle lock arrangement for a motor vehicle door, the motor vehicle door being adjustably connected to a motor vehicle body, comprising: a motor vehicle lock that in a mounted state is arranged on the motor vehicle door or on the motor vehicle body, wherein the motor vehicle lock arrangement comprises a push-open arrangement arranged to adjust the motor vehicle door in a motorized push-open procedure out of a door closed position into a door push-open position that is lying further in an opening direction of the motor vehicle door than the door closed position, and as a consequence a gap is produced between the motor vehicle body and a door engagement edge of the motor vehicle door, wherein a control arrangement and connected thereto in terms of control technology a sensor arrangement are provided, wherein the control arrangement is configured to detect via the sensor arrangement a predetermined operator's triggering gesture, and wherein the push-open procedure is triggered by the control arrangement in the event that the predetermined operator's triggering gesture is detected, wherein the control arrangement controls the push-open procedure in response to the detection of the operator's triggering gesture in such a manner that as a movement of the operator's hand progresses, in a direction of the door engagement edge at a point in time when the operator's hand arrives at the door engagement edge, the push-open procedure is already triggered, is already in an advanced stage or has already been completed.

2. The motor vehicle lock arrangement as claimed in claim 1, wherein the predetermined operator's triggering gesture includes a predetermined triggering hand movement and that the triggering hand movement includes a predetermined movement path or a predetermined movement speed or a predetermined movement speed progression or a predetermined movement acceleration or a predetermined movement acceleration progression.

3. The motor vehicle lock arrangement as claimed in claim 2, wherein the triggering hand movement moves toward the door engagement edge of the motor vehicle door or ends in a region of the door engagement edge of the motor vehicle door or brushes over the door engagement edge of the motor vehicle door.

4. The motor vehicle lock arrangement as claimed in claim 3, wherein at least one part of the triggering hand movement moves essentially in a transverse manner toward the door engagement edge.

5. The motor vehicle lock arrangement as claimed in claim 1, wherein the sensor arrangement is configured as a capacitive sensor arrangement, wherein between the measuring electrode and a further electrode or a motor vehicle ground there is a measured capacitance, wherein the magnitude of the measured capacitance is dependent upon the position of the operator's hand.

6. The motor vehicle lock arrangement as claimed in claim 5, wherein the at least one measuring electrode is configured in an elongated manner.

7. The motor vehicle lock arrangement as claimed in claim 6, wherein the at least one measuring electrode is configured essentially in a transverse manner with respect to at least one part of the triggering hand movement.

8. The motor vehicle lock arrangement as claimed in claim 5, wherein the sensor arrangement comprises at least one measuring electrode that is connected in terms of control technology to the control arrangement, wherein between the measuring electrode and a further electrode or the motor vehicle ground there is a measured capacitance, wherein a magnitude of the measured capacitance is dependent upon the position of the operator's hand.

9. The motor vehicle lock arrangement as claimed in claim 1, wherein the sensor arrangement is arranged at least in part in a hollow space of the motor vehicle door.

10. The motor vehicle lock arrangement as claimed in claim 9, wherein the sensor arrangement is arranged at least in part in a hollow space of the motor vehicle door behind an opening in the door outer panel of the motor vehicle door or that the sensor arrangement is arranged in a hollow space of the motor vehicle body, or that the sensor arrangement is arranged at least in part in or on an add-on part.

11. The motor vehicle lock arrangement as claimed in claim 9, wherein the sensor arrangement is arranged at least in part in a hollow space of the motor vehicle door behind an opening in the door outer panel of the motor vehicle door or that the sensor arrangement is arranged in a hollow space of the motor vehicle body, or that the sensor arrangement is arranged at least in part in or on an add-on part between the add-on part and the motor vehicle door.

12. The motor vehicle lock arrangement as claimed in claim 1, wherein the motor vehicle lock arrangement comprises a closing assist arrangement configured to adjust the motor vehicle door in a motorized closing assist procedure out of a door pre-closed position into a door main-closed position, wherein the door main-closed position lies further in a closing direction.

13. The motor vehicle lock arrangement as claimed in claim 12, wherein the closing assist arrangement provides at least a part of the push-open arrangement.

14. The motor vehicle lock arrangement as claimed in claim 13, wherein the closing assist arrangement and the push-open arrangement share one drive motor for generating drive movements.

15. The motor vehicle lock arrangement as claimed in claim 1, wherein the control arrangement controls the sensor arrangement differently in the case of a closed motor vehicle door than in the case of an at least slightly open motor vehicle door.

16. The motor vehicle lock arrangement as claimed in claim 1, wherein the motor vehicle lock comprises a lock latch that with a locking part, in this case a locking bar, and a retaining catch that is allocated to the lock latch and that the push-open arrangement is connected to the lock latch, within the push-open procedure the adjustment of the motor vehicle door into the door push-open position is in response to the adjustment of the lock latch in the opening direction by the push-open arrangement or that within the scope of the closing assist procedure the adjustment of the motor vehicle door into the door main-closed position is in response to the adjustment of the lock latch in a closing direction by the push-open arrangement.

17. The motor vehicle lock arrangement as claimed in claim 1, comprising an opening assist arrangement, wherein the retaining catch is configured to be released in a motorized manner and that within the scope of the push-open procedure the control arrangement initially triggers the motorized release of the retaining catch.

18. A method for controlling a motor vehicle lock arrangement as claimed in claim 1, wherein the control arrangement to detect via the sensor arrangement a predetermined operator's triggering gesture and that the push-open procedure is triggered by the sensor arrangement in the event that the predetermined operator's triggering gesture is detected.

19. The method as claimed in claim 18, wherein by the control arrangement the push-open procedure is controlled in response to the detection of the operator's triggering gesture in such a manner that as the movement of the operator's hand progresses in the direction of the door engagement edge at the point in time at when the operator's hand arrives at the door engagement edge, the push-open procedure is already triggered, is already in an advanced stage or has already been completed.

* * * * *